US007361033B2

(12) United States Patent
Lien

(10) Patent No.: US 7,361,033 B2
(45) Date of Patent: Apr. 22, 2008

(54) HANDHELD ELECTRONIC APPARATUS CAPABLE OF CONNECTING TO OTHER ELECTRONIC DEVICE

(75) Inventor: Chih-Wei Lien, Keelung (TW)

(73) Assignee: Qisda Corporation, Taoyuan (TW)

( * ) Notice: Subject to any disclaimer, the term of this patent is extended or adjusted under 35 U.S.C. 154(b) by 0 days.

(21) Appl. No.: 11/467,945

(22) Filed: Aug. 29, 2006

(65) Prior Publication Data

US 2007/0093094 A1 Apr. 26, 2007

(30) Foreign Application Priority Data

Oct. 24, 2005 (TW) ..... 94137182 A

(51) Int. Cl.
*H01R 13/44* (2006.01)

(52) U.S. Cl. ..... 439/131

(58) Field of Classification Search ..... 439/131
See application file for complete search history.

(56) References Cited

U.S. PATENT DOCUMENTS 5,135,406 A * 8/1992 Ishikawa ..... 439/131
6,014,346 A * 1/2000 Malone ..... 368/10
6,750,569 B2 * 6/2004 Liao ..... 307/147
7,097,018 B2 * 8/2006 Wu ..... 191/12.2 R
7,134,887 B1 * 11/2006 Keely ..... 439/131

FOREIGN PATENT DOCUMENTS

TW M252179 12/2004

* cited by examiner

*Primary Examiner*—Michael C. Zarroli
(74) *Attorney, Agent, or Firm*—Thomas, Kayden, Horstemeyer & Risley

(57) ABSTRACT

A handheld electronic apparatus includes a main body, at least a male connector and at least a female connector. The male connector is disposed in the main body for electrically coupling to an electronic device. The female connector is disposed in the main body for electrically coupling to another electronic device.

17 Claims, 3 Drawing Sheets

HANDHELD ELECTRONIC APPARATUS CAPABLE OF CONNECTING TO OTHER ELECTRONIC DEVICE

This application claims the benefit of Taiwan application Serial No. 94137182, filed Oct. 24, 2005, the subject matter of which is incorporated herein by reference.

BACKGROUND OF THE INVENTION

1. Field of the Invention

The invention relates in general to an electronic apparatus, and more particularly to a handheld electronic apparatus.

2. Description of the Related Art

Electronic apparatus can be seen everywhere nowadays. For example, people communicate to each other by mobile phones, do high-speed calculation by computers, and store various electronic files through portable storage devices.

In terms of present mobile phones, some manufacturers provide mobile phones with support function for insertion of memory cards to extend their storage capacity. However, in the process of file reading and transmission between the mobile phones and other electronic devices, the user has to prepare a transmission line beforehand, thereby leading to inconvenience in practical applications.

Besides, the user usually needs to additionally prepare a spare battery or a battery charger for use with his/her mobile phone. If the user forgets to carry the battery or the battery charger, he/she cannot use the mobile phone when the battery runs out. Therefore, the user needs to worry about carrying a spare battery or a battery charger with him/her all the time, which causes great inconvenience.

SUMMARY OF THE INVENTION

It is therefore an object of the invention to provide a handheld electronic apparatus. The spare battery can be charged as needed for the handheld electronic apparatus to perform file transmission even the user does not carry the battery charger.

The invention achieves the above-identified object by providing a handheld electronic apparatus including a main body, at least a male connector and at least a female connector. The male connector is disposed in the main body for electrically coupling to an electronic device. The female connector is disposed in the main body for electrically coupling to another electronic device. With the male connector and female connector both disposed in the handheld electronic apparatus, the user can conveniently access files and charge battery of the electronic apparatus without the need to carry any portable storage device or battery charger.

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 1:
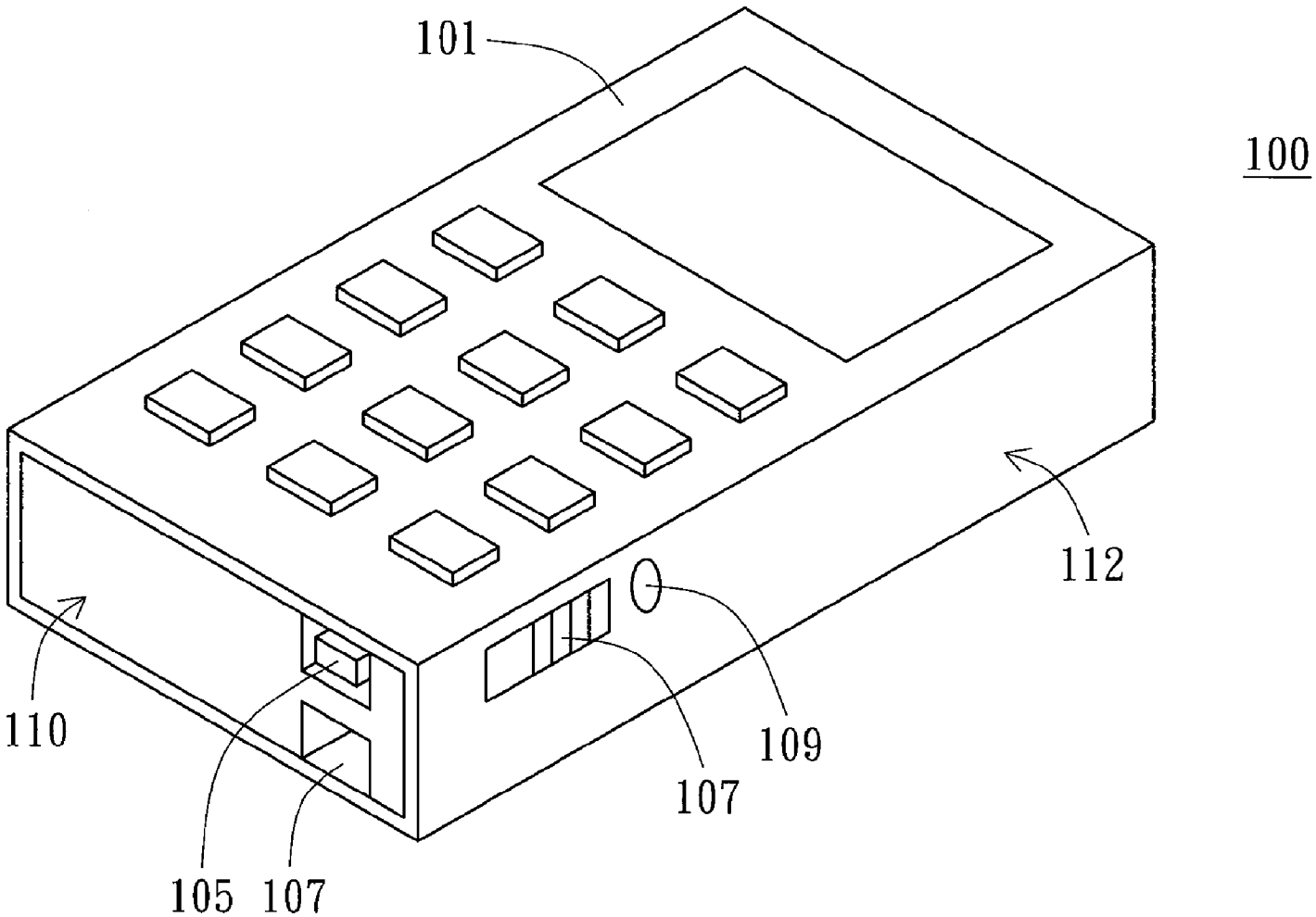
FIG. 1 is a solid view of a mobile phone according to a preferred embodiment of the invention.

Referring to FIG. 1, a solid view of a mobile phone according to a preferred embodiment of the invention is shown. The handheld electronic apparatus is a personal digital assistant (PDA) or mobile phone for instance. The mobile phone 100 is taken as an example for the electronic apparatus of the invention in the following description. The mobile phone 100 includes a main body 101, at least a male connector 103 and at least a female connector 105. The male connector 103 and the female connector 105 are disposed adjacently at the first side 110 of the main body 101. Of course, the male connector 103 and the female connector 105 can also be disposed on different sides of the main body 101. The second side 112 of the main body 101 includes a line-receiving button 109 and a wedge bar 107. The wedge bar 107 is connected to the male connector 103. The male connector 103 and the female connector 105 can be any type of transmission interface, such as USB transmission interfaces.

Figure 2A:
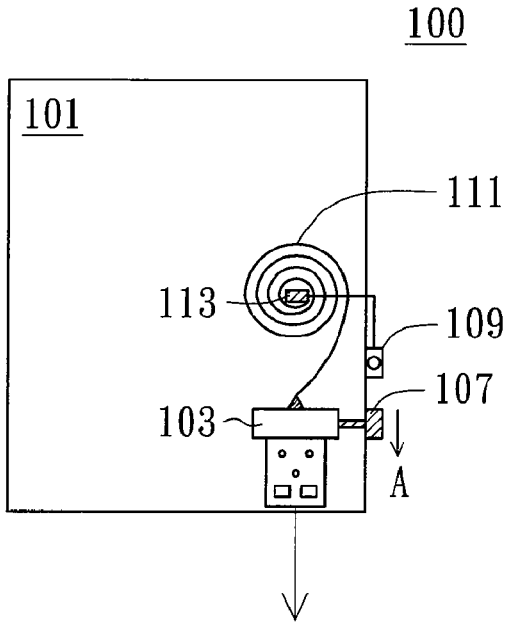
FIG. 2A is a schematic diagram of the mobile phone in FIG. 1 with the male connector located in the main body.
Figure 2B:
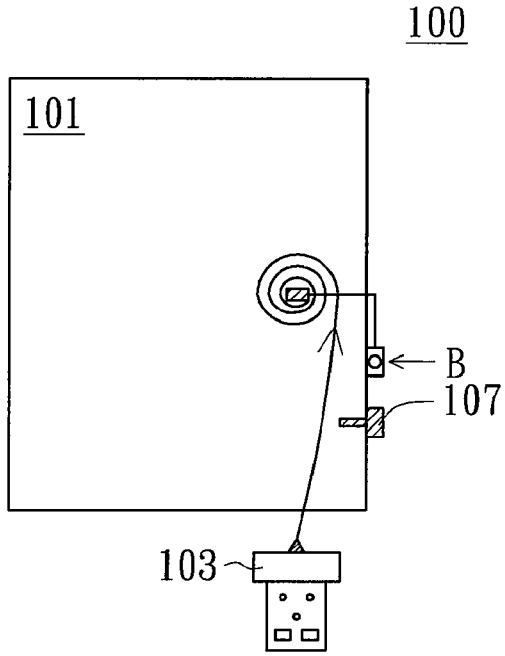
FIG. 2B is a schematic diagram of the mobile phone in FIG. 1 with the male connector separated from the main body.

FIG. 2A is a schematic diagram of the mobile phone 100 in FIG. 1 with the male connector 103 located in the main body 101. FIG. 2B is a schematic diagram of the mobile phone 100 in FIG. 1 with the male connector 103 separated from the main body 101. Referring to FIG. 2A and FIG. 2B at the same time, a transmission line 111 is disposed in the main body 101 and is wound around a winding reel 113. In this way, the transmission line 111 can be received in the main body 101 by the winding reel 113. A twist spring is disposed on the winding reel 113 for storing an elastic force. The twist spring is connected to the line-receiving button 109.

When the user is to use the male connector 103, the user takes out the male connector 103 by pushing the wedge bar 107 along direction A and takes the male connector 103 a distance away from the main body 101 by stretching the transmission line 111. Moreover, in the stretching process, an elastic restoring force is stored in the twist spring. By using the male connector 103, the mobile phone 100 can be electrically coupled to other electronic devices. For example, functions of battery charging and signal transmission can be performed on the mobile phone 100 by connecting the male connector 103 to a USB female connector of a computer. When the user uses the mobile phone 100, he/she needs not to carry a battery charger and spare batteries, and can charge the battery of the mobile phone 100 by connecting it to any electronic device with a USB female connector.

After completing usage of the male connector 103, the user only needs to press the line-receiving button 109 along direction B as shown in FIG. 2B. The twist spring is then triggered by the line-receiving button 109 to rotate the winding reel 113 and to receive the transmission line 111 by releasing the elastic restoring force. Therefore, the male connector 103 can be automatically received into the main body 101 along with the transmission line 111, which saves the time for retrieving the male connector 103.

Figure 2C:
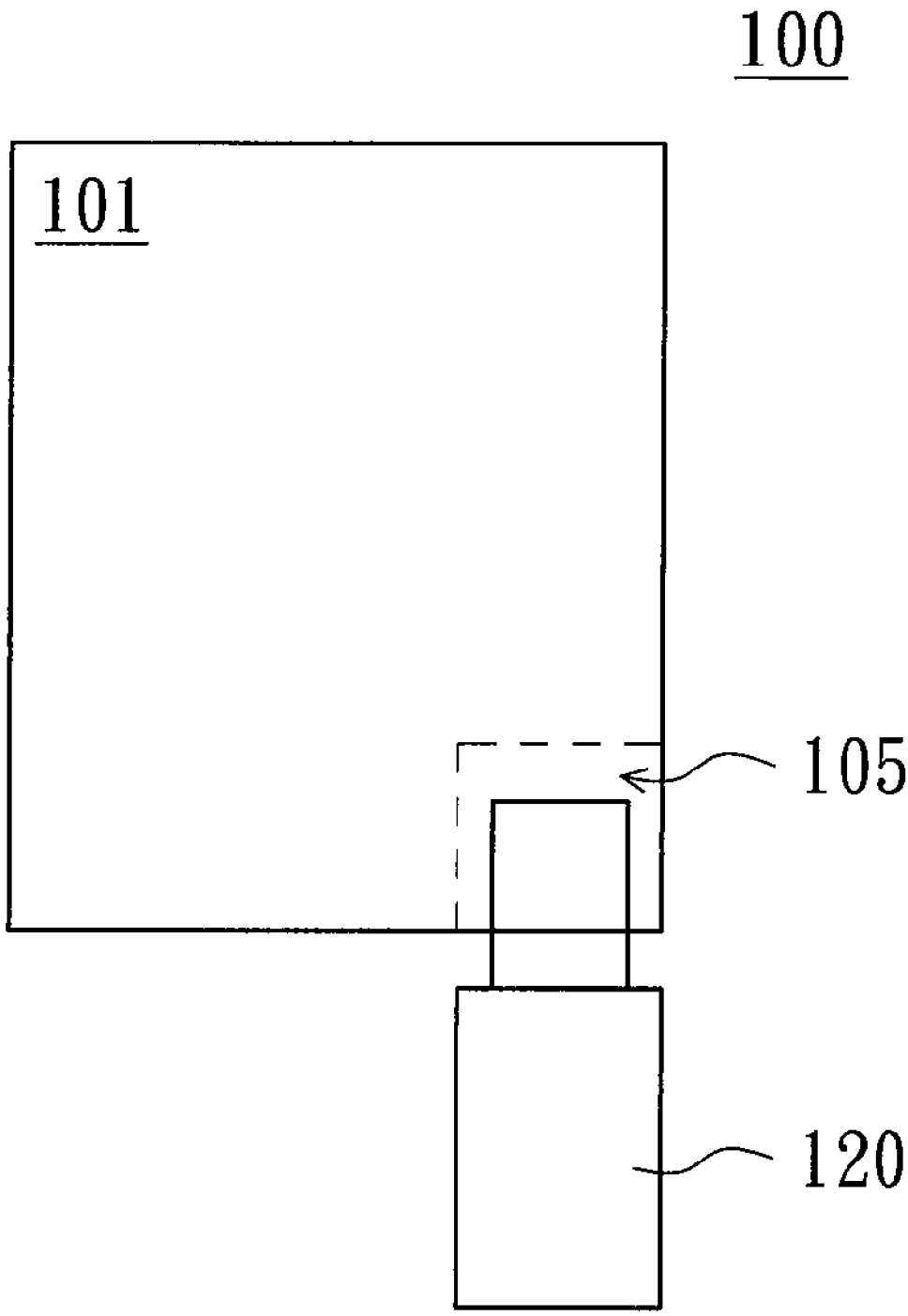
FIG. 2C is a schematic diagram of the mobile phone in FIG. 1 with another electronic device inserted to the mobile phone.

Referring to FIG. 2C, a schematic diagram of the mobile phone 100 in FIG. 1 inserted by another electronic device is shown. The main body 101 includes a female connector 105 in addition to the male connector 103. As shown in FIG. 2C, because the portable storage device 120 generally uses a USB transmission interface, it can be inserted into the female connector 105, which is also a USB transmission interface. Therefore, the user can conveniently transmit files and various signals between the mobile phone 100 and the portable storage device 120.

The handheld electronic apparatus disclosed by the above-mentioned embodiment of the invention can be applied to the mobile phone and personal digital assistant. Through having at least a male connector and at least a female connector both disposed in one handheld electronic apparatus, the user can use the handheld electronic apparatus as a tool for file transmission via the female connector or charging the battery and storing electrical power for the electronic apparatus by connecting its male connector to other electronic devices. Therefore, the user can use the mobile phone or personal digital assistant as a handheld electronic apparatus with multiple functions of information reception, file transmission, and battery charging without the need to carry an extra battery charger, a battery charge stand or a portable storage device.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A handheld electronic apparatus, comprising:
a main body;
at least a male connector, disposed in the main body for electrically coupling to an electronic device; and
at least a female connector, disposed in the main body for electrically coupling to another electronic device;
wherein the main body further comprises:
a transmission line connected to the male connector
a winding reel and the transmission line is extendably disposed in the main body; and
a line-receiving button connected to the winding reel for receiving the transmission line.

2. The apparatus according to claim 1, wherein the main body further comprises a twist spring disposed on the winding reel and connected to the line-receiving button, and when the line-receiving button is pressed, the twist spring is triggered to receive the transmission line by a restoring force.

3. The apparatus according to claim 1, wherein the main body further comprises a wedge bar connected to the male connector for pushing out the male connector from the main body.

4. The apparatus according to claim 1, is a mobile phone.

5. The apparatus according to claim 1, is a personal digital assistant (PDA).

6. The apparatus according to claim 1, wherein the male connector is a USB transmission interface.

7. The apparatus according to claim 1, wherein the female connector is a USB transmission interface.

8. The apparatus according to claim 1, wherein the male connector is disposed adjacent to the female connector.

9. The apparatus according to claim 1, wherein the male connector and the female connector are separately disposed in the main body.

10. A handheld electronic apparatus, comprising:
a main body, comprising:
a transmission line extendably disposed in the main body;
a winding reel; and
a line-receiving button connected to the winding reel for receiving the transmission line;
at least a male connector, disposed in the main body for electrically coupling to an electronic device, and connected to the transmission line; and
at least a female connector, disposed in the main body for electrically coupling to another electronic device.

11. The apparatus according to claim 10, wherein the main body further comprises a twist spring disposed on the winding reel and connected to the line-receiving button, and when the line-receiving button is pressed, the twist spring is triggered to receive the transmission line by a restoring force.

12. The apparatus according to claim 10, wherein the male connector is a USB transmission interface and the female connector is a USB transmission interface.

13. The apparatus according to claim 10, wherein the male connector is disposed adjacent to the female connector.

14. The apparatus according to claim 10, wherein the male connector and the female connector are separately disposed in the main body.

15. A handheld electronic apparatus, comprising:
a main body, comprising:
a transmission line extendably disposed in the main body;
a winding reel; and
a wedge bar;
at least a male connector, disposed in the main body for electrically coupling to an electronic device, and connected to the transmission line and the wedge bar; and
at least a female connector, disposed in the main body for electrically coupling to another electronic device;
wherein the wedge bar is used for pushing out the male connector from the main body.

16. The apparatus according to claim 15, wherein the male connector is a USB transmission interface and the female connector is a USB transmission interface.

17. The apparatus according to claim 15, wherein the male connector is disposed adjacent to the female connector.

* * * * *